US005859579A

United States Patent [19]

Branston et al.

[11] Patent Number: 5,859,579

[45] Date of Patent: Jan. 12, 1999

[54] CURRENT—LIMITING SWITCH

[75] Inventors: David Walter Branston; Jörg Kieser; Werner Hartmann; Reinhard Maier, all of Bundesrepublik, Germany

[73] Assignee: Siemens Aktiengesellschaft, München, Germany

[21] Appl. No.: 586,705

[22] PCT Filed: Jul. 25, 1994

[86] PCT No.: PCT/DE94/00862

§ 371 Date: Jan. 26, 1996

§ 102(e) Date: Jan. 26, 1996

[87] PCT Pub. No.: WO95/03619

PCT Pub. Date: Feb. 2, 1995

[30] Foreign Application Priority Data

Jul. 26, 1993 [DE] Germany ..... 4325030.0
Jul. 18, 1994 [DE] Germany ..... 4425330.3

[51] Int. Cl.[6] ..... H01H 81/02; H01H 37/72; H01H 37/36; H05B 3/10

[52] U.S. Cl. ..... 337/116; 337/117; 337/417

[58] Field of Search ..... 200/61.08; 337/114–122, 337/401–417, 142, 290–298; 338/20, 22 R, 225 D; 218/1, 117, 154–158

[56] References Cited

U.S. PATENT DOCUMENTS

| | | | |
|---|---|---|---|
| 3,356,808 | 12/1967 | Dakin et al. | 218/158 X |
| 3,743,993 | 7/1973 | Alley et al. | 337/114 |
| 3,848,213 | 11/1974 | Schmitt | 337/107 |
| 3,987,388 | 10/1976 | Niemeyer | 337/114 |
| 4,419,650 | 12/1983 | John | 337/119 |
| 4,481,498 | 11/1984 | Mc Tavish et al. | 338/20 |
| 4,510,480 | 4/1985 | Rossi et al. | 337/117 X |
| 4,542,365 | 9/1985 | Mc Tavish et al. | 338/20 |
| 4,549,161 | 10/1985 | Mc Tavish et al. | 338/20 |
| 4,550,301 | 10/1985 | Mc Tavish et al. | 338/20 |
| 4,642,136 | 2/1987 | Fukushima et al. | 338/22 R X |

FOREIGN PATENT DOCUMENTS

| | | | |
|---|---|---|---|
| 102574 | 3/1984 | European Pat. Off. | H01H 9/42 |
| 0 487 920 | 6/1992 | European Pat. Off. | H01C 1/14 |
| 2042265 | 9/1980 | United Kingdom | H01H 71/14 |
| WO91/12643 | 8/1991 | WIPO | H02H 3/093 |

*Primary Examiner*—J. R. Scott
*Attorney, Agent, or Firm*—Kenyon & Kenyon

[57] ABSTRACT

Such switches have current connections for contacts. One contact may be a fixed contact and the other contact may be a mobile contact. A drive opens the mobile contact when a predetermined electric current intensity is exceeded. The electric drive is a thermoelectric drive. For that purpose, the contacts (2,3) are arranged in a closed housing (1) made of an insulating material and a disk-shaped resistive member (4) is arranged between the contacts (2,3). A switch of this type may also be advantageously designed as a bistable limiter.

29 Claims, 3 Drawing Sheets

CURRENT— LIMITING SWITCH

Figure 1:
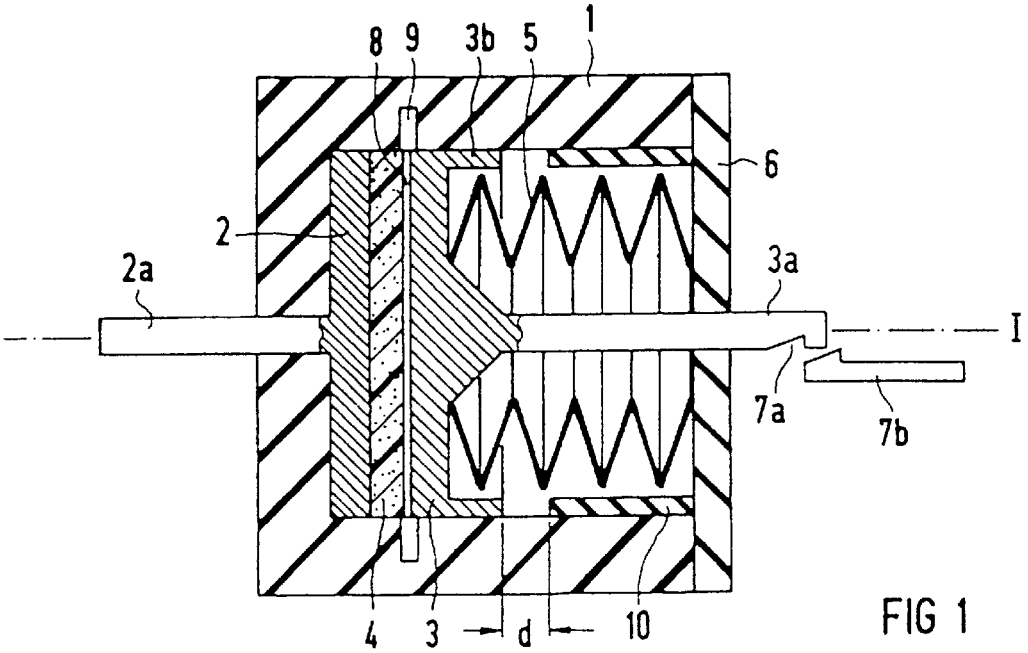

The invention relates to a current-limiting switch having current connections and contacts, of which one contact is a fixed contact and the other a mobile contact, and having an associated drive for opening the mobile contact when a predetermined electric current intensity is exceeded.

In power distribution networks, the current which flows when a short circuit occurs should be limited as much as possible in order to prevent damage to lines and loads since the only other way to prevent such damages is extreme overrating. Conventional mechanical low-voltage switches obtain the mechanical energy required for switching off from a spring energy store. In some cases, additional reinforcement is provided by the intrinsic magnetic field of the short-circuit current. The opening speed in such switches is limited by the complex mechanical construction on the one hand and the limited spring energy on the other. The current-limiting effect of such switches is thus restricted.

From the WO-A-91/12643 and the EP-A-0 487 920, current-limiting arrangements are known as series-connected devices for switches which specially exploit the PTC (positive temperature coefficient) effect. There, high-current resistors are used which consist essentially of a polyethylene layer filled with carbon black and exhibiting the PTC effect. In such a high-current resistor usable as a protective element, the polymer resistive member should be connected with its surface areas to an electrode in order to guarantee the PTC effect, a pressure device being present which exerts a pressure perpendicularly on the electrodes and the surface areas of the resistive member of the conductive polymer layer.

In contrast, it is the object of the invention to specify a current-limiting switch which works based on another physical principle.

This objective is solved according to the invention in a switch of the type stated in the introduction in that the drive for opening the mobile contact is a thermodynamic drive. With such a drive, it is possible to apply sufficient switching energies in a thermal manner.

In the invention, the contacts are arranged in a closed housing made of insulating material and a disk-shaped resistive member is arranged between the contacts. An expansion volume is preferably present between the resistive member and the mobile contact in the housing made of insulating material. The resistive member can consist of a plastic containing graphite, e.g., on the basis of polyethylene, or can be formed by a multitude of carbon fibers which are made into a film or felt-like consistency.

Unlike the prior art, the mechanical switching energy required for contact separation is thus applied electrothermally in the invention. For this purpose, the high-current discharges occurring in case of a short circuit first heats an enclosed gas volume. The resulting pressure wave acts upon a movable piston and carries out the mechanical contact opening work on it.

One advantageous feature of the invention is that through the use of a large-area resistive member with significantly higher electrical resistance compared to a metal, a localized melting of the electrodes is prevented on the one hand through the two-dimensional distribution of the current flow. On the other hand, a uniform heating of the gas chamber is encouraged.

The switch according to the invention is used in power distribution networks in the low-voltage area. In case of a disruption, particularly in case of short circuits, parts of the network must be switched away at higher-order branches. In order to limit or rather to avoid damages at the site of the disruption as well as in the area of the network, the disconnection should take place as quickly as possible, in particular, still within the first affected half cycle. In addition, limiting of the short-circuit current is also often required if the disconnection cannot be recognized quickly enough or rather cannot be carried out through suitable measures. The limiting of the short-circuit current also results in a limiting of the amplitudes of the voltage peaks generated in the disconnection due to the inductive load component in the network and in the load and thus reduces the risk of further damages due to insulation faults, which can be brought about by such overvoltages. In particular in building installations but also in other cases, the requirements made of the necessary components increase, and the components must exhibit high selectivity as a result.

The prior art is thus significantly improved upon. In particular, such methods which bring about a current limiting or current interruption in case of a short circuit in low-voltage networks correspond to this prior art. The most commonly used means for this purpose is the circuit-breaker, which, however, as a zero-point switch, always carries the current for at least a half cycle and is thus not suited alone for current limiting and rapid disconnection. Due to the relatively large masses moving in circuit-breakers, a rapid disconnection cannot be achieved at an acceptable cost. High-speed circuit breakers for high currents require very high accelerative forces in order to bring the moving masses of the electrode systems to separations of several millimeters in short intervals on the order of milliseconds. This is generally not possible with conventional spring energy stores such that appropriately powerful driving mechanisms are necessary.

Until now, technical solutions for the latter purpose involved, for example, pyrotechnic driving with chemical driving mechanisms which are electrically triggered as well as the so-called Thomson drive. Due to innate system disadvantages, however, neither of these methods has come into widespread use.

Such disadvantages are eliminated in the current limiter according to the invention. However, as a purely passive component, the working range is restricted so that a correspondingly large variety of types is necessary to adapt to the respective area of use. Due to the passive character of the operation, active and rapid disconnection coupled with early short circuit recognition is not possible.

With further invention, a bistable limiter can also be created through appropriate design of the switch. Such a switch according to the invention is lockable in the closed state and adjustable through a suitable energy store to a response threshold which lies above the maximum current to be expected in the high-load region. In the locked state, the volume resistance is so low that the nominal current losses are negligible. Thus, the intrinsic response threshold of the limiter lies on the order of magnitude of the prospective short-circuit current. In the unlocked state, the contact resistances increase and thus the energy turnover in the area of the switching contacts. Likewise, the intrinsic response threshold drops to a value in the nominal current region.

The unlocking can be triggered advantageously by an electronic early short-circuit detection device. This behavior is supported advantageously in that a second energy store is used which is under tension in the locked state and is constructed so as to lead to the mechanical opening of the mobile electrode of the limiter in the unlocked state. During the closing and locking of the limiter, this second energy store is automatically placed under tension.

For an appropriate design of the operating parameters, the current-limiter according to the invention is capable of not only limiting the current but also completely interrupting it, i.e., functioning as an opening switch. In this case, it is particularly advantageous if a second locking unit is provided which locks the limiter functioning as a high-speed circuit breaker in the opened state. The limiter is thus prevented from automatically going back to the closed state following successful interruption of the current. True bistable behavior is thus achieved.

In the switch according to the invention, it can be achieved with a passive circuit made of RLC elements that in case the current is cut off during the current half cycle, no harmful overvoltage peaks are generated. Voltage limiting elements such as zener diodes, varistors and surge diverters can be present for this purpose.

Further details and advantages of the invention are given in the following description of exemplary embodiments based on the drawing in conjunction with the further dependent claims.

Figure 2:
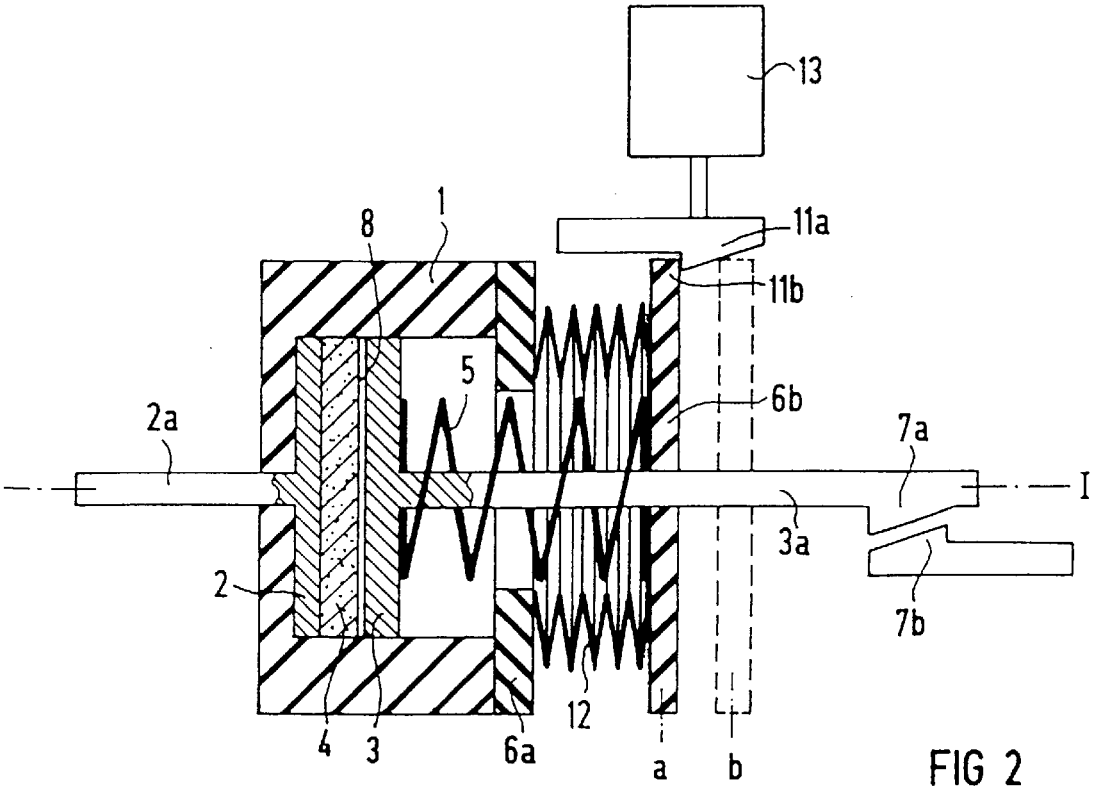
Figure 3:
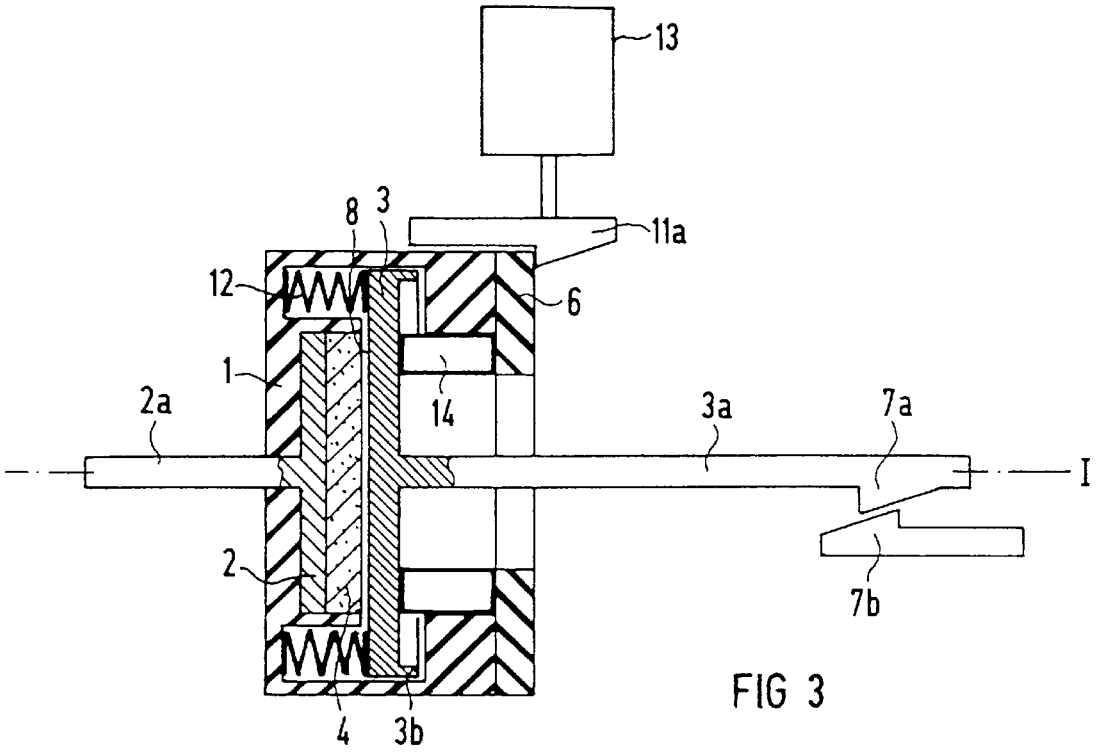
Figure 4:
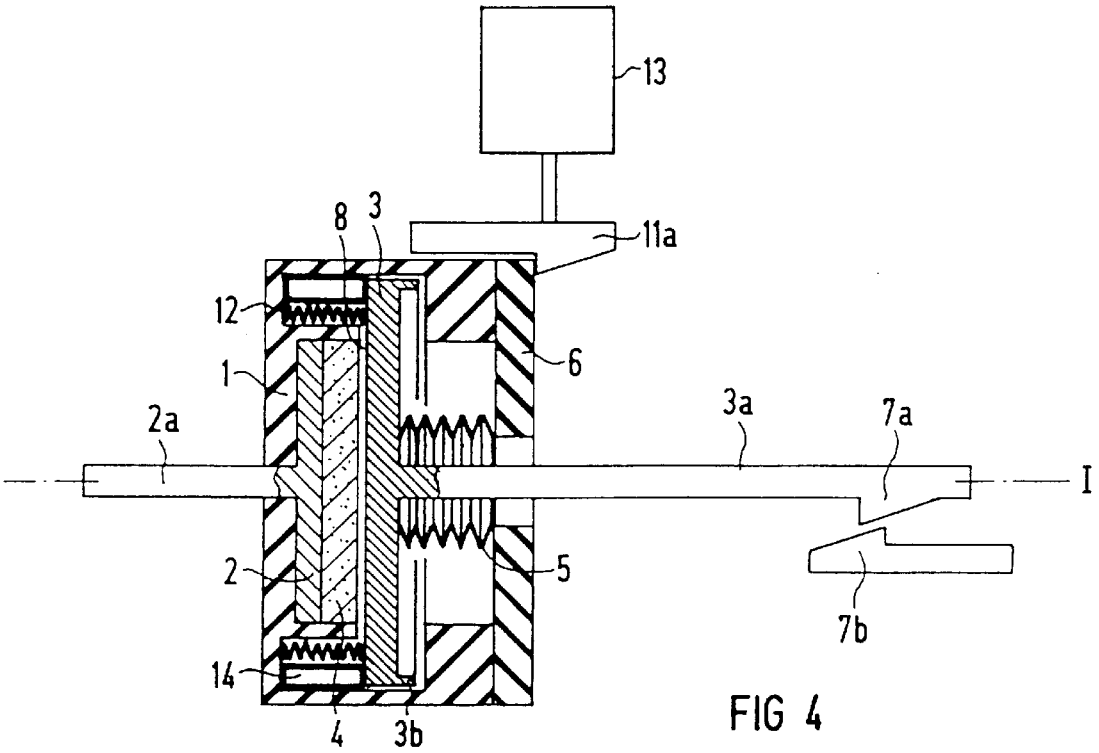
Figure 5:
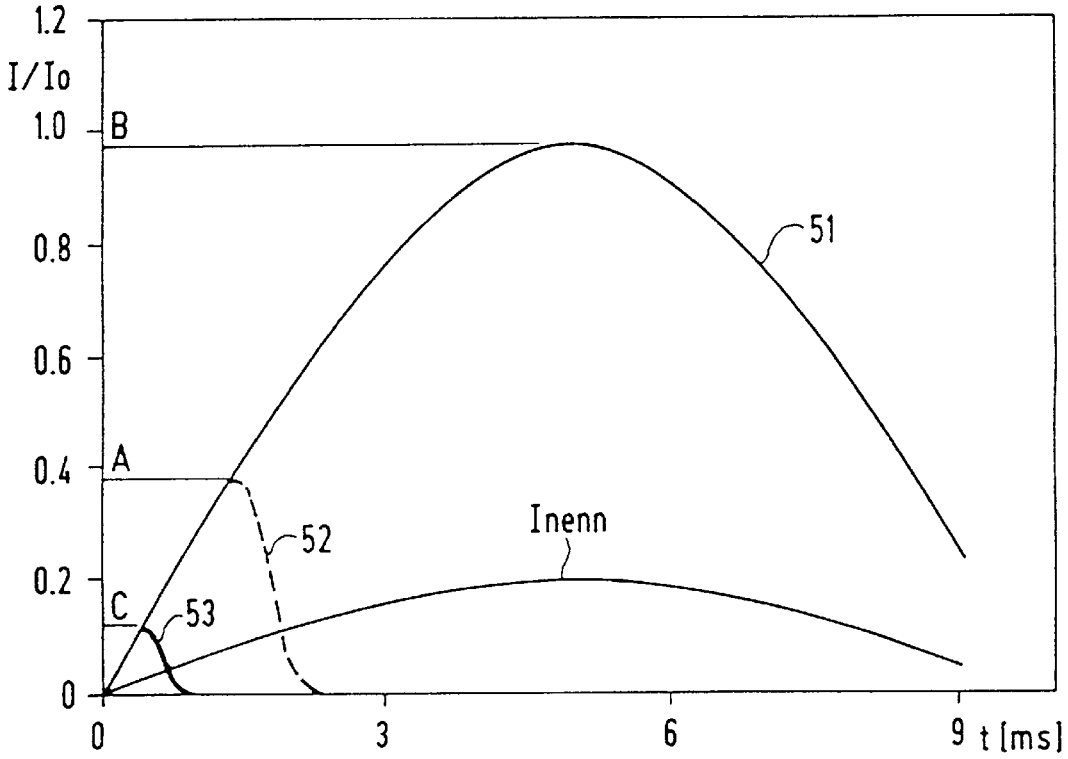

The following are shown schematically:

FIG. 1 an electrothermal switch for low-voltage applications,

FIGS. 2 to 4 three alternative further developments of such a switch for designing bistable limiters, and FIG. 5 a current vs. time diagram illustrating the advantageous switching behavior.

In the figures, identical or identically acting parts are given identical reference numbers.

In the figure, a housing made of insulating material is labelled 1, which forms, for example, a rotationally symmetrical hollow cylinder about an axis I. The hollow cylindrical housing made of insulating material 1 is closed by a flange 6.

In the housing made of insulating material 1, a fixed contact 2 having a current connection 2*a* in the axial direction is fitted rotationally symmetrically to the axis I. Separated from this, a mobile contact 3, whose current connection 3*a* also extends in the axial direction I, is fitted in a lengthwise mobile manner in the housing made of insulating material 1. Between the fixed contact 2 and the mobile contact 3, a disk-shaped resistive member 4 is arranged such that it abuts against the surface of the fixed contact 2 with no gap. The external contour of the resistive member 4 is fitted exactly into the housing made of insulating material 1.

Between the surface of the resistive member 4 away from the fixed contact 2 and the mobile contact 3, there is a joint face 8 designating a variable gap. In addition, an expansion volume 9 is present circumferentially in the wall of the housing made of insulating material 1.

The mobile contact 3 is pressed with its current connection 3*a* by a spring bellows 5 on the joint face 8 of the resistive member 4. The spring element 5 defines in this manner a mechanical preloading such that when it is overcome, the mobile contact 3 is shifted in the horizontal direction. The shifting can be limited by a ring 10 running circumferentially in the housing made of insulating material 1, it being possible to predetermine a suitable travel path d through appropriate dimensioning of a ring-shaped shoulder part 3*b* on the mobile contact 3 on the one hand and of the circumferential ring 10 on the other hand.

In the figure, the current connection 3*a* has at its outer end a notch 7*a* which can engage with an associated latch 7*b*. Means for locking the mobile contact in the open state are implemented in this manner.

The described switch can be installed in conventional power distribution networks. The current flows via the current connection 2*a*, the fixed contact 2, the resistive member 4 to the mobile contact 3, and from there via the current connection 3*a* back into the network. In case of a short circuit, the high-current discharging first heats up areally the enclosed gas volume via the fixed contact 2 and the disk-shaped resistive member adjacent to it. The resulting pressure wave shifts the mobile contact 3 to the stopping point, with a locking in the open state taking place via the notch 7*a* and the latch 7*b*.

The response threshold of the monostable switch shown in FIG. 1 is thus determined by the pressure force of the spring 5. This means that the spring is self-triggering but not controllable.

In contrast, the contact pressure spring 5 is fastened in FIG. 2 to an axially movable part 6*b* of the housing cover 6 with the parts 6*a* and 6*b*. The part 6*b*, which acts as a spring support, is locked in the position a via a locking mechanism 11*a* and 11*b* so that the spring 5 is preloaded and creates the pressure force needed for the closed state of the mobile electrode 3 on the resistive member. Simultaneously, a spring 12 provided for accelerating the opening process is preloaded. When the latch 11 is unlocked by an actuator 13, the spring support 6*b* is accelerated by the springs 5 and 12 in the axial direction away from the housing 1 so that the pressure force between the mobile electrode 3 and the resistive member 4 drops to very low values within a very brief interval. The contact resistance increases greatly in this process and the response threshold of the electrothermal drive falls to a value within the nominal current range of the switch.

In the development according to FIG. 2, the electrothermal drive triggers and the switch limits and interrupts or rather opens the current within a very short time, i.e., well below the prospective short-circuit current. In the fully open state, the mechanism 3*a* as well as 7*a* and 7*b* locks the mobile electrode 3 and thus prevents an undesired reclosing of the switch. The actuator 13 is driven and triggered, for example, by an electronic short-circuit detection device.

In another specific embodiment according to FIG. 3, the opening spring 12 touches the mobile electrode 3 directly and thus reinforces the opening through direct mechanical acceleration. A further acceleration of the opening process and a greater limiting of the current is achieved in this manner. The same effect can be achieved if the opening spring 12 is not fastened to the electrode 3 but rather to the guide element 3*b* or to the contact terminal 3*a* which is mechanically coupled to the mobile electrode 3. The energy store 5 is replaced specially in FIG. 3 by a piezoelectric actuator 14 which is driven simultaneously with the unlocking actuator 13. When driven, the actuator 14 reduces its length so that the contact pressure force is already reduced before the mobile electrode 3 is moved by the opening energy store.

In the specific embodiment according to FIG. 4, the piezoelectric actuator 14 is arranged parallel to the opening spring 12 and lengthens when driven. The contact pressure force of the pressure spring 5 is briefly overcompensated as a result and the spring effect is reinforced in the initial phase of the opening procedure.

The diagram according to FIG. 5 illustrates the opening behavior of the new switch. The curve 51 characterizes the behavior vs. time of the prospective short-circuit current. The curve 52 characterizes the current through the uncontrolled limiting element of conventional construction, with the value A giving the fixed response threshold value setting. The curve 53 characterizes the current through the new bistable limiter or rather high-speed circuit breaker, with the response threshold B of the locked limiter lying at or even above the prospective maximum short-circuit current. The response threshold C of the unlocked limiter lies within the nominal current range $I_{nenn}$ so that triggering can occur very early for non-dangerous current values. The triggering takes place through active unlocking via the early short circuit recognition electronics and the unlocking actuator 13.

The early short circuit recognition electronics detects short circuits within only a few microseconds after current zero. Due to the low moving masses in the actuator 13 and in the locking mechanism 11*a* and 11*b*, very early current limiting and opening is achieved in the switch so that the currents which actually occur can be limited to non-hazardous values within the nominal current range. The selectivity is achieved through the threshold value setting of the early short-circuit detection device and is thus adjustable within broad limits for an individual electromechanical switching element of type "BISTABLE LIMITER".

In FIGS. 2 to 4, the actuator 13 used for unlocking can be designed as an electromechanical or electromagnetic actuator. However, it can also be designed as a piezoelectric or piezostrictive element in order to accelerate the unlocking process due to decreased accelerated masses. Moreover, an actuator having a magnetostrictive element as an active component can be used.

It has been shown that the described bistable limiter which functions as a current limiter can be combined with an electronic early short-circuit detection device. Likewise in this combination, the limiter can work as a current-limiting high-speed circuit breaker. Suitable circuits for early short-circuit recognition are known from the prior art.

The resistive member 4 can consist of a conductive plastic such as the known polyethylene which is made electrically conductive. Graphite is used as a filler, for example. The resistive member 4 can also be made of graphite fibers which are made into a film- or felt-like consistency through suitable processing.

As a variation of this, a non-organic material with defined conductivity can also be used instead of the previously used organic material which was made conductive, such as polyethylene filled with carbon black. As the resistive member, highly doped semiconductor materials such as, in particular, polycrystalline silicon carbide can also be used.

In other specific embodiments, the spatial form can deviate from the rotational symmetry and can be present rectangularly with areal resistive members, for example. Multiple resistive members can also be connected in series. Moreover, suitable means for ventilating the inside of the housing made of insulating material 1 can also be provided.

What is claimed is:

1. A current-limiting switch comprising:

two current connections;

a fixed contact connected to one of said current connections;

a mobile contact connected to another one of said current connections; and a conductive resistive material disposed between said fixed contact and said mobile contact;

wherein when a predetermined electric current intensity is exceeded, high-current discharges at said resistive material heat a gas disposed in a volume between the fixed contact and the mobile contact to generate a pressure wave which displaces the mobile contact.

2. The switch according to claim 1, wherein the resistive material comprises a plastic containing graphite.

3. The switch according to claim 1, wherein the resistive material comprises a non-organic material which is a good conductor, such as polycrystalline silicon carbide.

4. The switch according to claim 1, further comprising a closed housing made of insulating material and enclosing said fixed contact and said mobile contact and wherein said resistive member comprises a disk-shaped member made of the resistive material.

5. The switch according to claim 4, further including an expansion volume present between said resistive member and said mobile contact in said housing.

6. The switch according to claim 4, wherein said resistive member comprises a multitude of carbon fibers which are made into a film- or felt-like consistency.

7. The switch according to claim 6, wherein said housing, said fixed contact, said mobile contact and said resistive member are arranged rotationally symmetrically and collinearly to said two current connections.

8. The switch according to claim 4, wherein said housing, said fixed contact, said mobile contact and said resistive member each have a rotationally symmetrical cross-section.

9. The switch according to claim 4, further comprising means for ventilating the inside of the housing.

10. The switch according to claim 1, further comprising means for setting a spring energy of said mobile contact.

11. The switch according to claim 1, further comprising means for limiting the travel of and locking said mobile contact.

12. The switch according to claim 1, wherein the switch is capable of being locked in an open state at a first time, and the switch is further capable of being locked in a closed state at a second time, the second time being different than the first time.

13. The switch according to claim 12, further comprising means for locking the switch in the closed state.

14. The switch according to claim 13, further comprising a means for unlocking the switch from the closed state.

15. The switch according to claim 14, further comprising a second energy store assigned to said means for unlocking.

16. The switch according to claim 15, wherein said means for unlocking includes actuators.

17. The switch according to claim 16, wherein the actuators are piezoactuators.

18. The switch according to claim 13, wherein said means for locking have an energy store assigned to them which is adjustable to a current response threshold which lies above the currents to be expected in the high-load region.

19. The switch according to claim 18, wherein said energy store is a pressure spring.

20. The switch according to claim 19, further comprising a means for unlocking the switch from the closed state.

21. The switch according to claim 20, further comprising a second energy store assigned to said means for unlocking.

22. The switch according to claim 18, further comprising a means for unlocking the switch from the closed state.

23. The switch according to claim 22, further comprising a second energy store assigned to said means for unlocking.

24. The switch according to claim 23, wherein said means for unlocking includes actuators.

25. The switch according to claim 24, wherein the actuators are piezoactuators.

26. The switch according to claim 12, further comprising a means for unlocking the switch from the closed state.

27. The switch according to claim 26, further comprising a second energy store assigned to said means for unlocking.

28. The switch according to claim 27, wherein said means for unlocking includes actuators.

29. The switch according to claim 28, wherein the actuators are piezoactuators.

* * * * *